US005280847A

United States Patent [19]

Blum et al.

[11] Patent Number: 5,280,847

[45] Date of Patent: Jan. 25, 1994

[54] TEEMING SPOUT

[75] Inventors: Matthias Blum, Alzenau; Wilfried Goy, Kelsterbach; Erich Zuckerstätter, Gelnhausen, all of Fed. Rep. of Germany

[73] Assignee: Leybold Durferrit GmbH, Cologne, Fed. Rep. of Germany

[21] Appl. No.: 3,705

[22] Filed: Jan. 13, 1993

[30] Foreign Application Priority Data

Jul. 8, 1992 [DE] Fed. Rep. of Germany ..... 4222399

[51] Int. Cl.[5] ..... B22D 41/60

[52] U.S. Cl. ..... 222/593; 266/237

[58] Field of Search ..... 266/236, 237; 222/591, 222/594, 593

[56] References Cited

U.S. PATENT DOCUMENTS 4,324,266 4/1982 Garnier et al. ..... 222/594
4,428,894 1/1984 Bienvenu ..... 264/9
5,074,532 12/1991 Ducroq et al. ..... 266/237

FOREIGN PATENT DOCUMENTS 1003778 3/1957 Fed. Rep. of Germany ..... 266/237
3533964 1/1987 Fed. Rep. of Germany .
4011392 10/1991 Fed. Rep. of Germany .
6000529 1/1976 Japan ..... 266/237
1-298103 1/1989 Japan .
2-43305 2/1990 Japan .
0931295 5/1982 U.S.S.R. .

*Primary Examiner*—Scott Kastler
*Attorney, Agent, or Firm*—Felfe & Lynch

[57] ABSTRACT

A teeming spout has on its inside a plurality of picket-like metal segments (1) separated from one another by slots (2) and is externally surrounded by an induction coil (3). The bottom turn (7) of this induction coil (3) has a downwardly directed pitch equalization piece (8) which provides such that the field acts uniformly on the teeming stream from all sides and therefore it is not deflected.

9 Claims, 1 Drawing Sheet

TEEMING SPOUT

BACKGROUND OF THE INVENTION

The invention relates to a teeming spout which has on its inside a plurality of picket-like metal segments separated from one another by slots and on its outside it is surrounded by an induction coil having a power feed at one end and a power return at its other end.

A teeming spout of the above kind is described for example in DE-A 40 11 392. The induction coil is represented in that document as if on the side with the power feed and power return the same number of turns run one above the other as on the opposite side. Since the windings, however, must be helical in shape, there will necessarily be one less winding section on the side opposite the power feed and power return. Consequently the field there is weaker than it is at the power feed and return. For this reason a transverse component of the force of the magnetic field develops by which the metal stream is deflected. For many applications, therefore, it cannot be alligned precisely enough.

DE-A 41 40 723 (U.S. Ser. No. 07/868,542) describes two induction coils for teeming spouts, which are symmetrical and therefore produce a symmetrical field, thereby preventing any lateral deflection of the metal stream. Such induction coils, however, are difficult to make and due to opposite current directions in adjacent winding areas and to intersections they lead to considerable energy losses.

SUMMARY OF THE INVENTION

The invention is addressed to configuring a teeming spout such that a centered, focused and undeflected pouring stream will be achieved with the simplest possible means.

In areas of an intensified magnetic field, means are provided for the local attenuation of the magnetic field, or in areas of a diminished magnetic field means are provided for intensifying the local magnetic field.

By this configuration it becomes possible to use conventional induction coils for the teeming spout, which can be made at relatively low cost, without incurring any deflection of the pouring stream. Instead of making the induction coil symmetrical with great difficulty, asymmetries are accepted according to the invention and compensated by intensifying or attenuating the field.

Intensification of the field on the side remote from the power feed and return can be achieved especially simply if an electrically conductive pitch equalizing piece extending the winding downwardly is arranged on the bottommost winding of the induction coil on the side opposite the power feed and return.

Such a pitch equalizing piece can consist, for example, of copper and be brazed onto the bottom spiral of the coil on the side facing the segments, so that it extends downward beyond this turn. The field on this side is thereby drawn further downward so that symmetrical forces result.

The transverse forces are exactly in balance when the bottom, axial termination of the coil lies with the bottom edge of the pitch equalizating piece on a plane normal to the central axis of the teeming spout.

Instead of prolonging the conducting portion of the induction coil downward, it is possible according to another embodiment to intensify the magnetic field by making the segments extend further downward on the side opposite the power feed and power return than they do on the side of the power feed and power return. An exact equalization of all transverse forces will result if the bottom edge of all segments is at an angle to the normal direction of the central axis of the teeming spout.

According to another embodiment, a ring of electrically conductive material is disposed below the induction coil as a short-circuit ring which on the side of an intensified magnetic field is at a shorter axial distance from the induction coil than it is on the opposite side.

Such a ring, which can be a water-cooled copper ring, produces at that location an intensified counter-field, where due to the induction coil an intensified field is present. It therefore provides for an equalization of the field. It furthermore provides for a space free of the field underneath it, which often is necessary for add-on devices.

The ring can operate virtually without field losses if it consists of ferrite as a field-guiding component. Such a ring does not produce a counter-field but steers the field of the induction coil only in a desired direction.

For the fine tuning of the field it is advantageous for the ring to be made adjustable as regards the inclination toward the axis of the induction coil and/or its axial distance therefrom.

Another possibility for making the forces acting upon the teeming stream uniform consists in locating at least one marginal turn of the induction coil at a greater distance from the induced material than the other turns.

The invention admits of numerous embodiments. For a better understanding of its basic principle a number of them are represented schematically in the drawing and are described herewith.

DETAILED DESCRIPTION OF THE PREFERRED EMBODIMENT

Figure 1:
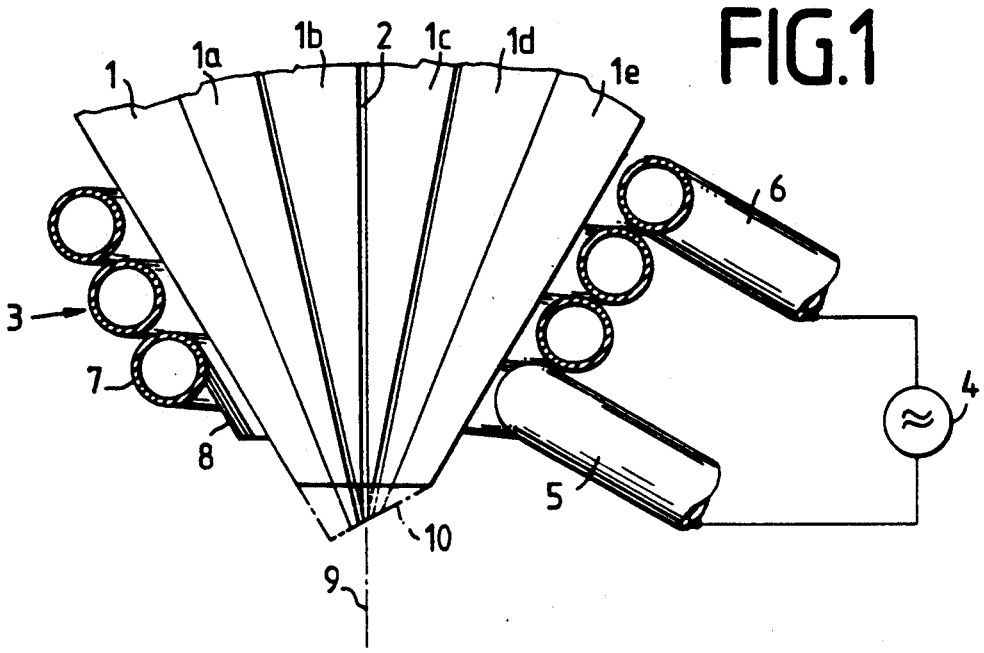
FIG. 1 is a vertical section through a teeming spout in accordance with the invention.

For the guidance of the molten metal stream, the teeming spout represented in FIG. 1 has a plurality of picket-like segments 1*a*, 1*b*, 1*c*, 1*d*, 1*e* of electrically conductive material separated from one another by gaps 2. On the outside around the teeming spout is an induction coil 3 which is supplied with electrical power by a power source 4 through a power feed 5 and a power return 6.

On account of the pitch of the spirals of the induction coil 3, there will be one less turn on the side opposite the power feed 5 and power return 6 than on the other side. In order to nevertheless achieve a uniform magnetic field, a pitch equalizing piece 8 of electrically conductive material, a copper piece for example, is brazed to the bottom turn 7 of the induction coil 3. This pitch equalizing piece 8 reaches so far downward that its bottom edge on the side of the power feed 5 lies in a plane normal to the central axis of the teeming spout indicated at 9.

In FIG. 1 a variant is indicated in broken lines, which can be made in addition to the pitch equalizing piece 8 or in place of it. Accordingly, the segments 1, 1*a*, 1*b*, 1*c*, 1*d* and 1*e* are prolonged downward such that a slanting edge 10 is formed. In this way too a field intensification can be achieved on the side opposite the power feed 5 and power return 6.

Figure 2:
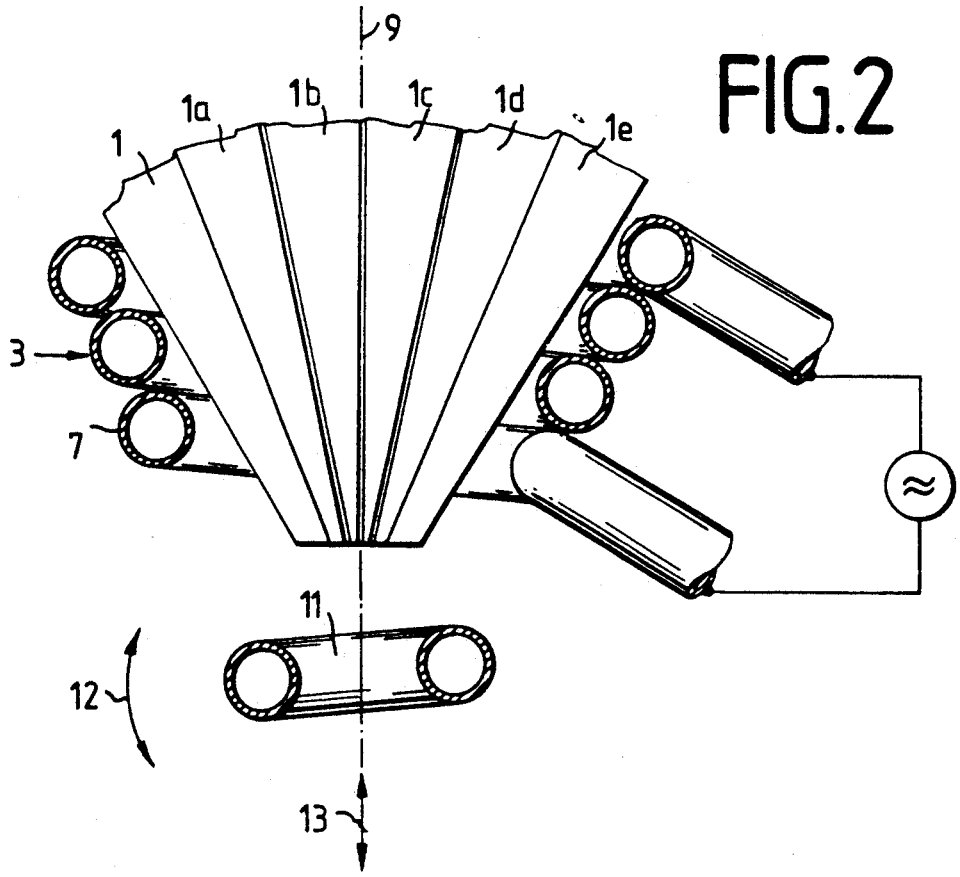
FIG. 2 is a vertical section through another embodiment of a teeming spout according to the invention.

In the embodiment according to FIG. 2, a ring 11 is disposed underneath the induction coil 3. It can consist of an electrically conductive material, copper for example, and thus it can be a short-circuit ring producing a counter-field to the induction coil 3. However, it is also possible to provide a ring 11 of ferrite as a field guiding component thereby largely preventing field losses. As indicated by arrows, the ring 11 can be made adjustable in its inclination to the central axis 9 and in regard to its axial distance from coil 3.

As an additional variant of the invention, FIG. 2 shows that, in this embodiment, the bottom turn 7 is at a greater distance from the segments 1, 1*a*, 1*b*, 1*c*, 1*d* and 1*e* than the other turns. Irregularities of the field can be compensated in this manner as well. It is also possible, of course, to increase not the diameter but the axial distance of the bottom turn 7 from the next-higher turn.

Not shown is an embodiment in which air pressure can be applied to the air above the surface of the bath of the molten metal flowing through the teeming spout. This makes it possible to create a high teeming velocity and to minimize the effect of field irregularities. In this manner provision can also be made for a constant rate of outflow as the depth of the metal bath decreases.

It is also possible to refrain from any measures for making the field uniform, and to steer the metal in the desired direction by a cross-flow of gas to prevent it from being deflected.

We claim:

1. Teeming spout for inductively heating a stream of molten metal poured therethrough, comprising a plurality of metal segments separated from one another by slots and arranged about a central pouring axis, said slots being at least substantially parallel to said axis, an induction coil arranged helically around said metal segments, said coil having a top turn, a bottom turn, a power feed connected to one of said turns, said power feed and said power return being connected to said turns on the same side of said axis, said coil producing a magnetic field which produces forces acting on said stream of molten metal transversely of said axis, and means for balancing said magnetic field without any additional coil so that said forces acting on said stream of molten metal are uniform around said axis.

2. Teeming spout as in claim 1 wherein said means for balancing said magnetic field comprises a pitch equalizing piece fixed to said bottom turn opposite said side of said axis where said power feed and power return are connected.

3. Teeming spout as in claim 2 wherein said pitch equalizing piece has a bottom edge on a plane normal to said axis.

4. Teeming spout as in claim 1 herein said means for balancing said magnetic field comprises downwardly extending extensions of said metal segments opposite said side of said axis where said power feed and power return are connected.

5. Teeming spout as in claim 4 wherein said extensions have bottom edges on a plane inclined with respect to said axis.

6. Teeming spout as in claim 1 wherein said means for balancing said magnetic field comprises a ring of electrically conductive material about said axis below said bottom turn, said ring being inclined with respect to said axis so that it is closer to the bottom turn on the side where said power feed and power return are connected.

7. Teeming spout as in claim 1 wherein said means for balancing said magnetic field comprises a ferrite ring about said axis below said bottom turn.

8. Teeming spout as in claim 7 wherein said ferrite ring is inclined with respect to said axis.

9. Teeming spout as in claim 1 wherein at least said bottom turn is at a greater distance from said axis on the side opposite said axis from the side where said power feed and said power return are connected.

* * * * *